US005529354A

United States Patent [19]

Studt et al.

[11] Patent Number: 5,529,354

[45] Date of Patent: Jun. 25, 1996

[54] SPRING PACK ASSEMBLY

[75] Inventors: Timothy K. Studt; Benjamin L. Sheets, both of Rice Lake, Wis.

[73] Assignee: Wright Products Corp., Minneapolis, Minn.

[21] Appl. No.: 272,100

[22] Filed: Jul. 8, 1994

[51] Int. Cl.[6] ..... E05C 1/08

[52] U.S. Cl. ..... 292/336.3; 292/163; 292/DIG. 61

[58] Field of Search ..... 292/163, 169.19, 292/226, 336.3, DIG. 53, DIG. 61, DIG. 64, 348, 353

[56] References Cited

U.S. PATENT DOCUMENTS

| | | | |
|---|---|---|---|
| 4,569,547 | 2/1986 | Fayerman | 292/DIG. 61 |
| 4,884,835 | 12/1989 | Smallegan | 292/DIG. 61 |
| 5,046,772 | 9/1991 | Su | 292/DIG. 53 |
| 5,125,696 | 6/1992 | Robida | 292/DIG. 61 |
| 5,177,987 | 1/1993 | Shen | 292/336.3 X |
| 5,205,596 | 4/1993 | Ralph | 292/336.3 |
| 5,265,924 | 11/1993 | Kim | 292/336.3 |
| 5,286,074 | 2/1994 | Lin | 292/336.3 |
| 5,322,333 | 6/1994 | Norton | 292/DIG. 61 |
| 5,335,948 | 8/1994 | Norton | 292/336.3 |

OTHER PUBLICATIONS

Wright Products Corp. Brochure, pp. 4–11.
Wright Products Corp. Brochure, pp. 24–27.
*EXHIBIT A:* Series of Drawings of Spring Pack Assembly.
*EXHIBITS B, C & D:* Series of Photographs of Spring Pack Assembly.

*Primary Examiner*—Steven N. Meyers
*Assistant Examiner*—Gary Estremsky
*Attorney, Agent, or Firm*—Merchant, Gould, Smith, Edell, Welter & Schmidt

[57] ABSTRACT

A latch apparatus includes a spring pack assembly for returning a latch to its normal non-use position. The spring pack assembly includes a holder portion and a cap for retaining a torsion spring. The holder portion includes retaining members and an annular member extending upward from the base of the holder for retaining and positioning the torsion spring. The adapter portion extends opposite the retaining members and annular member to receive a spindle for actuating the handle. The spring pack assembly inserts under a latch plate on the surface of the door and can be positioned so that the handle can be actuated in either direction and return to its non-use position and so that the handle can be oriented either to the left or right and either pointing upward or downward when not being used.

4 Claims, 5 Drawing Sheets

SPRING PACK ASSEMBLY

BACKGROUND OF THE INVENTION

1. Field of the Invention

The present invention relates to a latch apparatus and in particular to a door latch including a spring pack assembly for recentering the latch handle.

2. Prior Art

The present invention is directed to a latch apparatus, and in particular, to a spring assembly for a latch apparatus.

Latches, such as those used for doors, have been known in various forms for a very long time. Such door latches are normally actuated by rotating a lever or knob. The actuation configuration can take many different forms. For example, in some applications, a knob or lever may need to be rotated to the left to actuate, while in others, it may be necessary to actuate it to the right. In addition, in some applications, it may be necessary to have the lever extending downward and rotate up to actuate or it may be necessary to have the lever extending upward and turning down to actuate, or it may be necessary to have the lever extending to one of the sides and rotating either up or down to actuate.

Latch handles, including both levers and knobs, are often mounted on a spindle which also actuates the handle. However, a common problem with this configuration is that the connection to the spindle can loosen with time and use. In addition, a separate adapter piece must be placed on the spindle to connect the handle. This connection may also loosen over time. The knob or handle often droops and may even fall off of the spindle, rendering the latch and handle unusable.

Another problem associated with the use of latches is the need to do substantial modifications on the door and create space within the door to receive the mechanism for the latch. This is very time consuming and runs the risk of a mistake being made and thereby ruining the door. Existing latches also require significant procedures for installation. This increases time required for the installer and increases risk for incorrect installation.

Known latch devices require a separate handle and spring configuration to accommodate different uses, different mounting positions, and different types and direction of actuation. This can lead to greater production costs, greater numbers of parts being needed as each use may need different elements, and more difficult installations.

It can be seen then, that a new and improved latch is needed which can use the same components for various mounting positions and various types of actuation. It can also be appreciated that such a latch is easier to mount if the components can be mounted on the exterior of the door with minimum modifications to the door. The latch should have a handle return which allows the knob or handle to be turned in either direction, yet returns the handle to its normal non-use position. In addition, the latch should have a knob or handle which is not mounted and supported on the return mechanism, so that it does not droop or fall. The present invention addresses these and other problems associated with door latches.

SUMMARY OF THE INVENTION

The present invention is directed to a latch apparatus and in particular to a latch apparatus incorporating an improved spring pack assembly. The latch generally includes an inner and outer handle with one of the handles having a cammed retainer member engaging a complementary portion mounted on the door frame. A latch plate is mounted on one side of the door and has a handle lever rotatably mounted to the latch plate. The latch plate also houses the spring pack assembly so that no parts need to be mounted inside the door. Therefor, less work is done to the door and greater mounting flexibility is achieved without requiring additional parts. A spindle connects the levers of the latch through the spring pack assembly for actuation. The door only requires an orifice formed therethrough for receiving the spindle and may include other orifices for mounting, but requires no other modifications to accommodate the present invention. In addition, the assembly of the latch is simplified. To install, the handle is positioned, then the spring pack is inserted into place. Because of the configuration of the adapter, handle and latch plate, the spring pack cannot be inserted incorrectly.

The spring pack assembly includes a holder portion and a cap portion which mount together to retain a torsion spring having tabs extending radially outward therefrom. The holder portion includes an annular raised member extending upward from a substantially flat circular base. Opposite the annular portion is an adapter portion extending to receive the spindle. The adapter portion also includes a retainer clip for holding the spring pack in place. The retainer clip holds the spring pack away from the door to prevent rubbing on the door. The adapter portion and retainer clip insert into the lever for rotatably connecting therewith. The adapter includes an orifice, preferably a square orifice to receive the spindle which is also square in a preferred embodiment. The holder also includes tab retaining members at a periphery of the base portion extending upward to the cap portion. The torsion spring is mounted so that the tabs are slightly biased against the tab retaining members of the holder.

The latch plate includes a curved spring pack assembly retaining portion for receiving the spring pack assembly with corners at both ends of the curved portion. The spring pack holder base and cap both have a larger diameter portion and a smaller diameter portion for fitting into the latch plate with the smaller diameter portion engaging the curved retaining portion of the latch plate. In this manner, the spring pack assembly is always properly held and aligned. When properly aligned, the tabs of the spring also are proximate the corner portions of the curved retainer plate. In this manner, when the latch is actuated and the spring pack assembly is turned, one spring tab member is forced against a tab retaining member of the spring pack assembly while the opposite tab engages one corner of the retainer plate. A biasing force moves the handle levers back to their original position. When the handles are actuated in the opposite direction, the tab roles are reversed and the spring bias again returns the latch to its original position.

It can be appreciated that with the present invention, the handle lever may be rotated to four positions to accommodate the adapter and the retainer clip. The square orifice in the handle receiving the square adapter and retainer clip can be rotated 90 degrees to change the nonactuated position of the main lever. It can be appreciated that with this configuration, the handle may be normally positioned pointing either up or down or either to the left or the right. This allows great flexibility for a variety of uses without additional modifications to the handle or door.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference letters and numerals indicate corresponding structure throughout the several views.

DETAILED DESCRIPTION OF THE PREFERRED EMBODIMENT(S)

Figure 1:
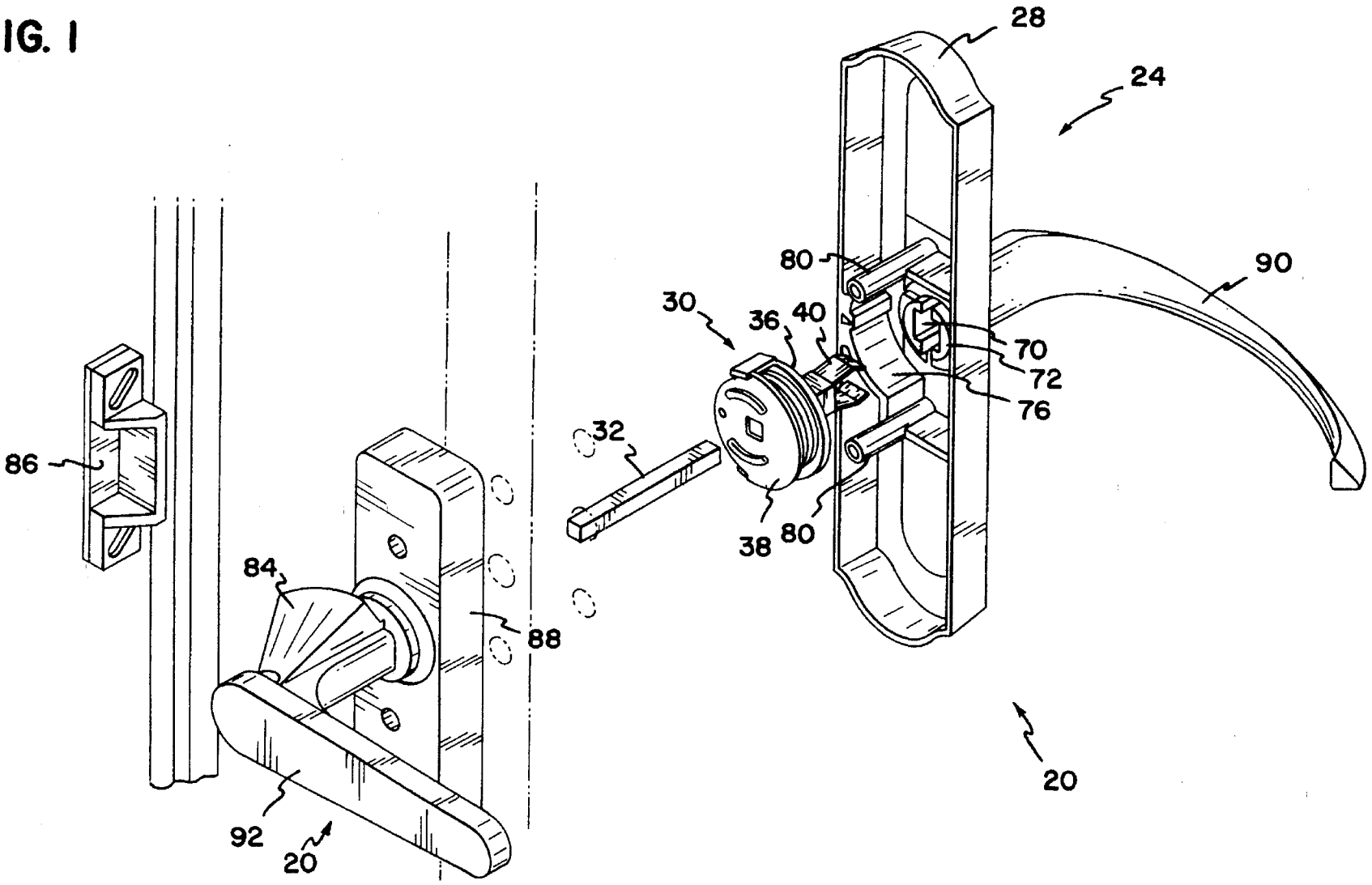
FIG. 1 shows an exploded perspective view of a latch for a door including a spring pack assembly according to the principles of the present invention.

Referring now to the drawings, and in particular to FIG. 1, there is shown a latch apparatus, generally designated 20 which is utilized with a door shown in phantom. The latch 20 includes an outer portion with a latch handle 24 including a lever 90 and an inside portion including an inner handle 26 with a lever 92. Although levers 90 and 92 are shown, it can be appreciated that knobs or other actuating members may be utilized. In addition to the outer handle 24, is a latch plate 28 mounts on the surface of the door (shown in phantom) including a spring pack assembly 30 housed substantially within the latch plate 28. A square spindle 32 connects the inside handle 26 through the spring pack 30 to the outside latch handle 24. The outside handle 24 includes a receiver 72 with a square orifice 70 for receiving a retainer clip member 40 mounted on the spring pack assembly 30. The retainer 40 presses against the receiver 72 and holds the spring pack assembly 30 in place. The inner handle 26 mounts to the door on a mounting block 88 and includes a cammed latching member 84 formed thereon which engages a retainer block 86 which forms a cavity with the door frame for receiving the latching member 84.

The latch 20 mounts to the door with bolts extending through the mounting block 88 to bosses 80 on the latch plate 28. It can be appreciated that with the present invention, only three holes need to be formed in the door, one for the spindle 32 and two for the bosses 80.

Figure 7:
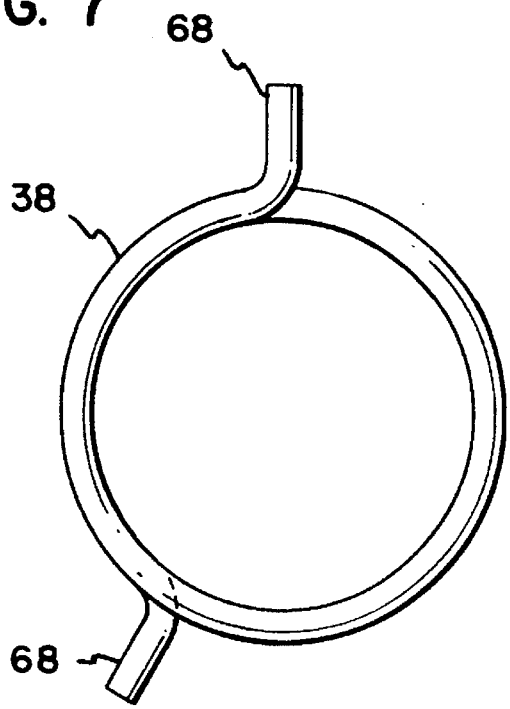
FIG. 7 shows a top plan view of a torsion spring for the spring pack assembly shown in FIG. 3; and, FIG. 8 shows an end elevational view of the spring pack holder shown in FIG. 4.
Figure 8:
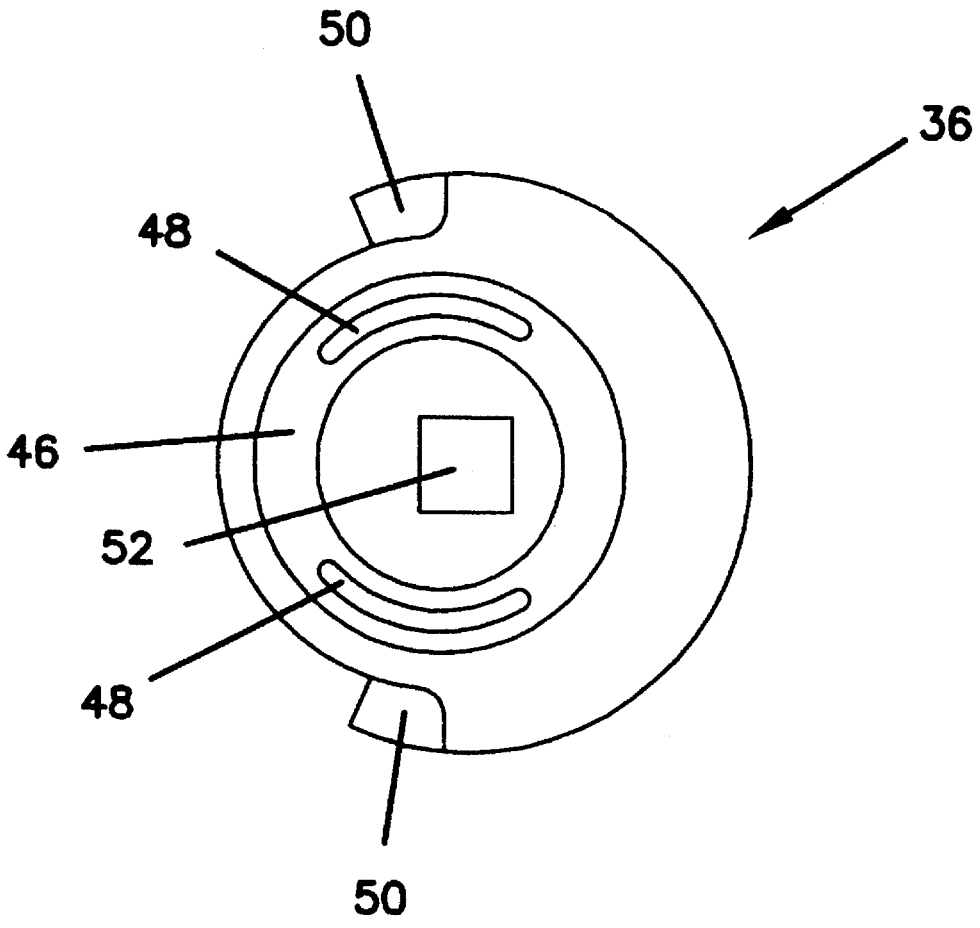

In FIG. 7, there is shown the torsion spring 34. At each end of the spring is a tab 68 extending radially outward for engaging portions of the spring pack assembly 30 and latch plate 28, as explained hereinafter. The tabs 68 are positioned more than 90 degrees apart but less than 180 degrees for positioning the spring 34 and positioning the spring pack assembly 30. The spring 34 has a diameter larger than the annular member 46 but less than the distance between retainer members 50.

Figure 3:
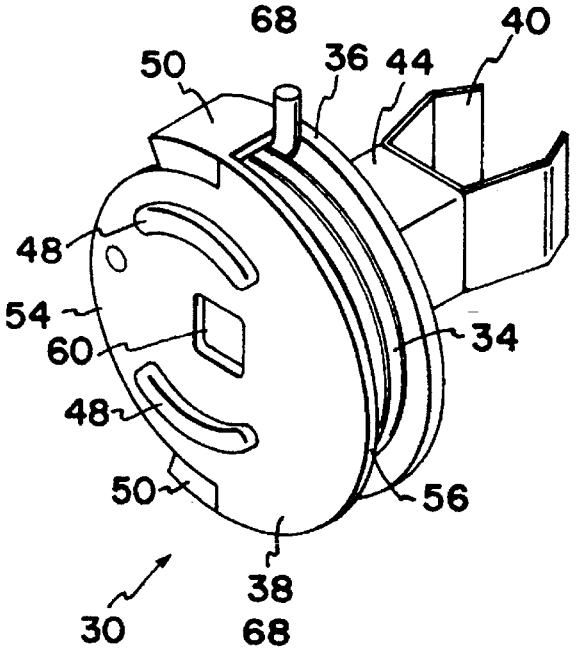
FIG. 3 shows a perspective view of the spring pack assembly for the latch shown in FIG. 1.
Figure 5:
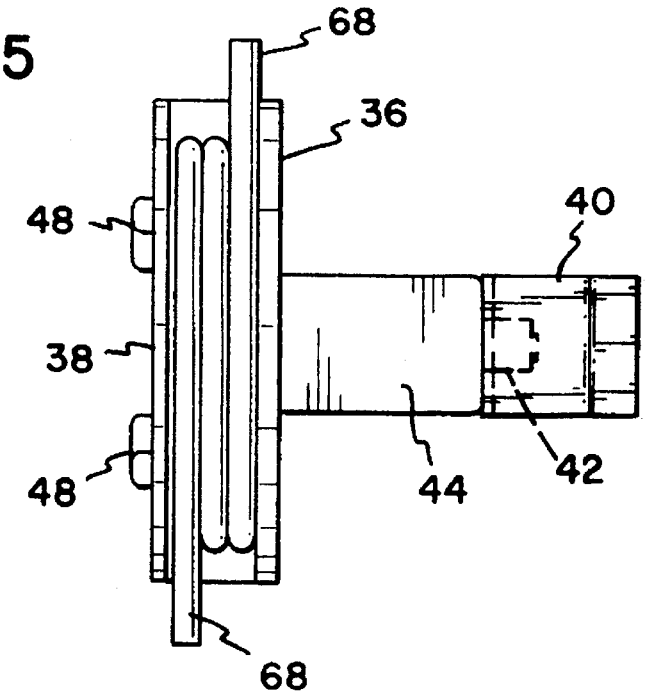
FIG. 5 shows a side elevational view of the spring pack assembly shown in FIG. 3.

Referring to FIGS. 3–6 and 8, the spring pack assembly 30 is shown. The spring pack assembly 30 includes a holder member 36 and a cap member 38 which retain and hold a torsion spring 34. The holder member 36 includes an adapter 44 extending downward from the base of the holder 36 and a mounting finger 42 for mounting the retainer clip 40 thereon. With the present holder 36, the adapter portion 44 is integral with the holder 36. The holder 36 and adapter portion 36 and 44 include a square cavity 52 formed therein for receiving the spindle 32. In addition, the holder 36 also includes a raised annular spring positioning member 46 configured to insert inside the spring 34. The raised member 46 includes raised curved portions 48 inserting through corresponding curved orifices in the cap member 38. The annular raised member 46 is offset from the center of the spring pack 30 for positioning and holding the spring 34. At an outer portion of the holder 36 stop acting as tab retainer members 50 for holding and positioning the end tabs 68 of the spring 34. The spring tabs 68 are positioned and biased against the tab retainer members 50 and held by the annular member 46. With the present configuration, the spring tabs 68 press against the retaining members 50. This pushes the spring 34 away from the retaining members 50 and would move the spring 34 to a position off center from the spring pack 30. The annular member 46 is placed off center from the spring pack 30 toward the retaining members 50. The annular member 46 engages the inside of the spring 34 and prevents the spring 34 from moving off center, maintaining proper alignment and ensuring proper spring function. As shown in FIG. 3, it can be appreciated that the cap member 38 and the base of the holder member 36 which have a similar periphery both include a larger diameter portion 56 and a smaller diameter portion 54 for positioning the spring pack assembly 30 on the latch plate 28, as explained hereinafter.

Figure 2:
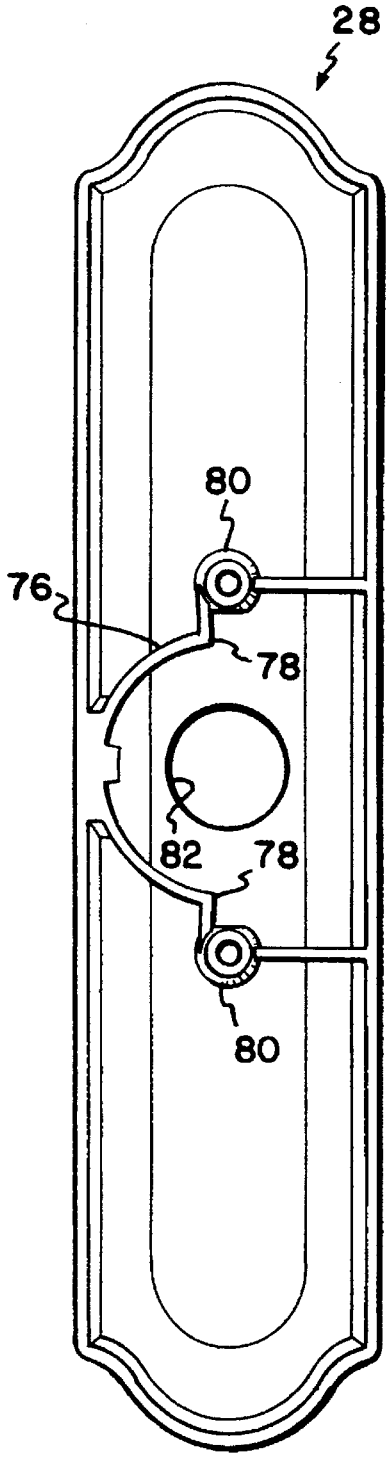
FIG. 2 shows an elevational view of the inside of a latch plate for the latch shown in FIG. 1.
Figure 6:
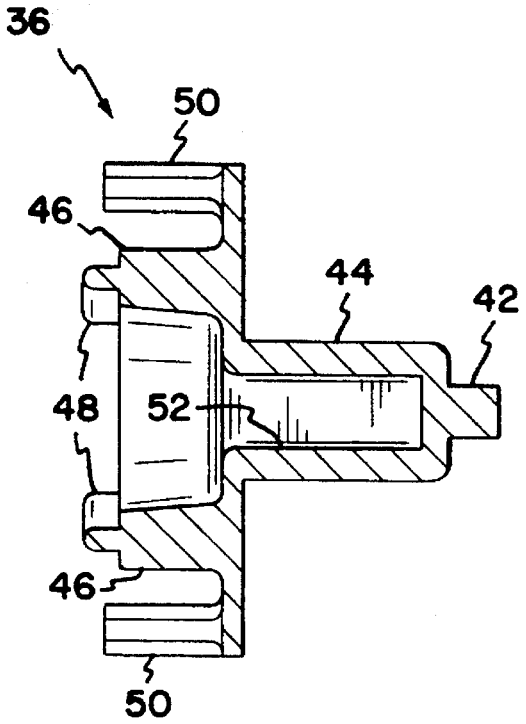
FIG. 6 shows a side sectional view of the spring pack assembly holder shown in FIG. 4.
Figure 4:
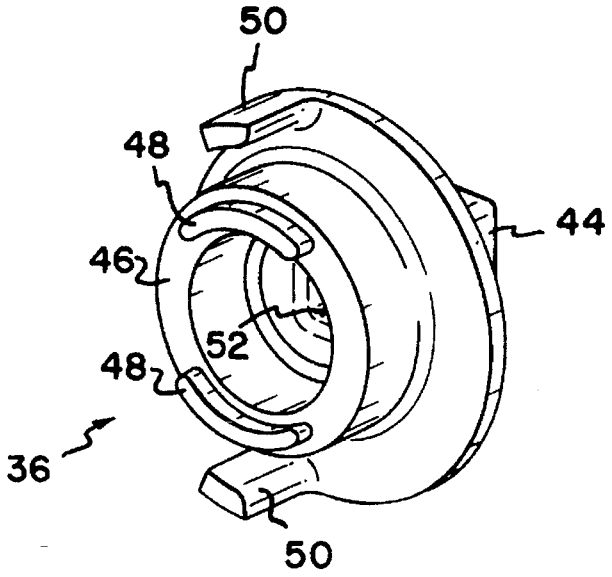
FIG. 4 shows a perspective view of the spring pack holder for the spring pack shown in FIG. 3.

Referring now to FIG. 2, there is shown the latch plate 28. The latch plate 28 includes an orifice 82 for receiving rotating receiver 72 of the handle 24 which accepts the adapter portion 44 and retainer clip 40 of the spring pack assembly 30, as shown in FIG. 1. Referring again to FIG. 2, the latch plate 28 also includes a curved spring pack retaining member 76 which has a radius configured to engage the smaller diameter portions 54 of the spring pack assembly 30. In addition, bolts or screws for mounting the latch plate to the door insert through the bosses 80. At the ends of the curved spring pack holder 76 are corner portions 78 which engage the spring tabs 68 for positioning the handles.

To mount the handle 24, it is positioned either pointing vertically upward, pointing vertically downward, or pointing right or left. The handle lever 90 position can be changed by rotating it 180 degrees or 90 degrees in either direction prior to insertion of the spring pack assembly 30, adapter 44 and spring clip 40 into the orifice 70, as shown in FIG. 1. It can be appreciated that the spring pack assembly 30 mounts in the same single position, but that the handle lever 90 can be rotated to any of its positions as required by the geometry of the door and frame. In this manner, the handle lever 90 may be used for either left or right opening doors and also for positions wherein the handle must point upward or downward. It can also be appreciated that since the handle 24 mounts directly to the latch plate 28 rather than being supported by the spindle, there is no possibility that the handle 24 might loosen from its connection to a spindle and droop. With the present invention, a more secure mounting arrangement is achieved.

When the latch 20 is mounted, the latch plate 24 is pressed tightly against the door with the inner handle mounting block 88 pressed against the door on the opposite side. It can be appreciated that the tabs 68 of the spring 34 will be pressed against both of the retainer members 50 on the spring pack assembly 30. It can also be appreciated that the tabs 68 are proximate the corners 78 on the curved spring pack retainer 76 of the latch plate 28. Therefore, should the handle 24 be actuated in one direction or the other, the tabs 68 of the spring will center the handle levers 90 and 92 back towards their original position and also close the latch 20. Since the spring pack assembly 30 is rotatably mounted with the spindle 32 and the rotating member 72 of the handle, rotation of either handle lever will also move the spring pack assembly 30. However, rotation deforms the spring 34 so that there is a bias resisting the movement from the centering position. In particular, one tab 68 will be engaging a corner 78 of the spring plate holder 76 while the opposite tab 68 will be engaging the retaining member 50 in the spring pack assembly 30 as the spring pack assembly 30 rotates. The tab 68 which has rotated with the spring pack assembly 30 places a bias on the retaining member 50 back to the original position. Similarly, if the latch 20 is rotated in the opposite direction, the opposite retainer member 50 and corner portion 78 will both be engaged by the opposite spring tabs 68 to return the latch 20 to its original centered position. In this manner, the mechanism is self-centering when the handles 24 and 26 are actuated in either direction.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A spring apparatus for a latch, comprising:

a torsion spring including end stop members;

a square spindle member;

a housing, including:

a first housing member having an orifice formed therein configured for receiving the spindle;

a second housing member comprising a base, an integral spindle holder portion extending outward from the base forming a cavity configured for receiving the square spindle, spring retaining members extending opposite the holder portion at the periphery of the base selectively configured to engage the end stop members, and an annular member extending from the base opposite the holder portion, wherein the annular member is positioned for inserting through the center of the torsion spring, and the spring retaining members outside the torsion spring to retain the torsion spring, wherein the annular member and housing each have a center axis, the center axis of the annular member being offset from the axis of the housing nearer the spring retaining members.

2. A spring apparatus according to claim 1, wherein the second housing member includes a base portion and a pair of side spring retaining members, wherein the second housing member is configured to cooperate with the first housing member to retain the torsion spring.

3. A spring apparatus according to claim 1, further comprising an adapter portion extending outward from the holder portion.

4. A spring apparatus according to claim 3, wherein the adapter portion further comprises a clip member.

* * * * *